United States Patent [19]

Paton et al.

[11] 4,249,153

[45] Feb. 3, 1981

[54] RING TRANSFORMER FOR RESISTANCE BUTT WELDERS

[76] Inventors: Boris E. Paton, ulitsa Chkalova, 41k-a, kv. 26; Vladimir K. Lebedev, ulitsa Engelsa, 25, kv. 12; Sergei I. Kuchuk-Yatsenko, ulitsa Filatova, 1/22, kv. 47; Vasily A. Sakharnov, ulitsa Solomenskaya, 41, kv. 93; Boris A. Galyan, ulitsa Lenina, 88/92, kv. 110; Stanislav D. Dobrovolsky, ulitsa Zhukova, 22, kv. 7; Mikhail N. Sidorenko, ulitsa Vladimirskaya, 98/3, kv. 54, all of Kiev, U.S.S.R.

[21] Appl. No.: 22,441

[22] Filed: Mar. 21, 1979

[30] Foreign Application Priority Data

Jun. 15, 1978 [SU] U.S.S.R. ..... 2621709[I]

[51] Int. Cl.[3] ..... H01F 27/30

[52] U.S. Cl. ..... 336/82; 336/178; 336/180; 336/192; 336/212; 219/116

[58] Field of Search ..... 336/82, 192, 212, 178, 336/180, 182, 196, 229; 219/116

[56] References Cited

U.S. PATENT DOCUMENTS

| | | | |
|---|---|---|---|
| 3,205,463 | 9/1965 | Thompson | 336/82 |
| 3,271,712 | 9/1966 | Bradshaw | 336/82 |
| 3,732,514 | 5/1973 | Sato | 336/212 |
| 4,024,370 | 5/1977 | Sciaky | 336/229 |

FOREIGN PATENT DOCUMENTS

| | | | |
|---|---|---|---|
| 2323215 | 1/1977 | France | 336/229 |
| 93847 | 11/1964 | U.S.S.R. . | |
| 178429 | 1/1966 | U.S.S.R. . | |

*Primary Examiner*—Thomas J. Kozma
*Attorney, Agent, or Firm*—Fleit & Jacobson

[57] ABSTRACT

According to the invention, the ring transformer for resistance butt welders comprises a plurality of sections, each composed of a non-closed magnetic core, a part of the primary winding and a part of the secondary winding. Each section is so arranged with respect to the other sections that the end faces of its non-closed magnetic core are in contact with the end faces of the two adjacent sections, whereby the non-closed magnetic cores of all the sections make up a closed magnetic core of the transformer. The primary winding of each section is connected to those of all the other sections so that they all make up the primary winding of the transformer. The secondary winding of each section is connected to those of the other sections so that they all make up the secondary winding of the transformer.

7 Claims, 6 Drawing Figures

RING TRANSFORMER FOR RESISTANCE BUTT WELDERS

FIELD OF THE INVENTION

The present invention relates to resistance butt welding equipment and, more particularly, to ring transformers for resistance butt welders.

The transformer of this invention can be employed to advantage in resistance butt welders intended for welding articles of extended sections, such as large-diameter pipes or sheets, as well as articles of compact sections, such as rails and shafts.

BACKGROUND OF THE INVENTION

There is known a ring transformer for resistance butt welders, comprising a closed magnetic core of a shape that essentially corresponds to that of articles being welded, as well as a primary winding and a secondary winding arranged on the magnetic core and uniformly extending along the butts of articles to be welded (cf. USSR Inventor's Certificate No 93,847, Cl. 21 h 32/03, published in 1964).

The magnetic core of the transformer under review is a solid member of a round, rectangular or polygonal section. If necessary, the core may be split in the longitudinal direction and provided with an appropriate joint. Thus the shape of the magnetic core is invariably designed for a specific article, wherefore the welder incorporating such a transformer cannot be used for welding articles of different cross-sectional configurations.

The primary winding must be drawn through a hole of a non-detachable closed magnetic core; this is an arduous manual operation which hardly lends itself to mechanization. If the magnetic core is detachable the individual sections of the primary winding are fitted over it from its ends so that there is a wide gap between the core and the winding, which accounts for increased losses and a reduced efficiency and thus affects the transformer's parameters. Another disadvantage is the presence of an open area on the lateral surfaces of the primary and secondary windings, which is hard to insulate. As a result, the primary winding may be shorted against the secondary winding or the magnetic core by drippings liberally produced in the course of butt welding. A breakdown of a portion of the primary or secondary windings makes it necessary to dismount and rewind the transformer, which often involves a dismantling of the whole welder.

SUMMARY OF THE INVENTION

It is an object of the present invention to provide a ring transformer for resistance butt welders, which would be more reliable than conventional transformers used for the same purpose.

It is another object of the invention to facilitate the manufacture of ring transformers for resistance butt welders.

It is still another object of the invention to facilitate repair of ring transformers.

It is yet another object of the invention to increase the versatility of ring transformers.

It is a further object of the invention to facilitate the assembly and dismantling of ring transformers.

The foregoing and other objects of the present invention are attained by providing a ring transformer for resistance butt welders, comprising a closed magnetic core whose shape essentially corresponds to that of articles to be welded, as well as a primary winding and a secondary winding, the primary winding being arranged on the magnetic core and uniformly extending along the butts of articles being welded, whereas the secondary winding is arranged on the primary winding and also uniformly extends along the butts of articles being welded, the transformer being characterized, according to the invention, in that it is composed of a plurality of sections, each comprising a nonclosed magnetic core, a part of the primary winding and a part of the secondary winding and being so arranged with respect to the other sections that the end faces of its nonclosed magnetic core are in contact with those of the non-closed magnetic cores of the two adjacent sections, whereby the non-closed magnetic cores of all the sections make up the closed magnetic core of the transformer, the primary winding of each section being connected in parallel, in series or in series-parallel with those of the other sections, making up the primary winding of the transformer, while the secondary winding of each section and those of all the other sections make up the secondary winding of the transformer.

In order to reduce the magnetic induction at the points where the end faces of the non-closed magnetic cores come into contact with one another, it is expedient that the nonclosed magnetic core of each section should be of a variable cross-section increasing towards the end faces of this nonclosed magnetic core.

In order to improve the contact between the end faces of the non-closed magnetic cores, as well as the electric insulation of these end faces, and in order to eliminate vibration, it is desirable that the transformer should be provided with spacers of an elastic insulating material, interposed between the end faces of the nonclosed magnetic cores of the transformer's sections.

In order to rule out folding of the non-closed ends of the secondary winding under the action of electromagnetic forces, it is advisable that the transformer should be provided with rings of a nonmagnetic material, fitted over the secondary winding in immediate proximity to its nonclosed ends and intended to bear the electromagnetic forces and thus prevent folding of the ends of the secondary winding.

The above design facilitates the manufacture of ring transformers and makes it possible to assemble a transformer from sections of practically any configuration corresponding to the shape of articles to be welded. The transformer according to the invention is easy to repair, which is done by simply replacing a faulty section. The small gap between the primary winding, secondary winding and magnetic core accounts for reduced losses and an increased efficiency. Finally, the transformer of this invention makes it possible to operate at a minimum possible distance from the butts of articles being welded and thus reduce the resistance of the secondary circuit of the welder; as a result, welding is done at a reduced capacity and less power is consumed.

BRIEF DESCRIPTION OF THE ACCOMPANYING DRAWINGS

The foregoing and other objects of the present invention will become more apparent from a consideration of the following detailed description of a preferred embodiment thereof to be read in conjunction with the accompanying drawings, wherein.

DETAILED DESCRIPTION OF THE INVENTION

Figure 1:
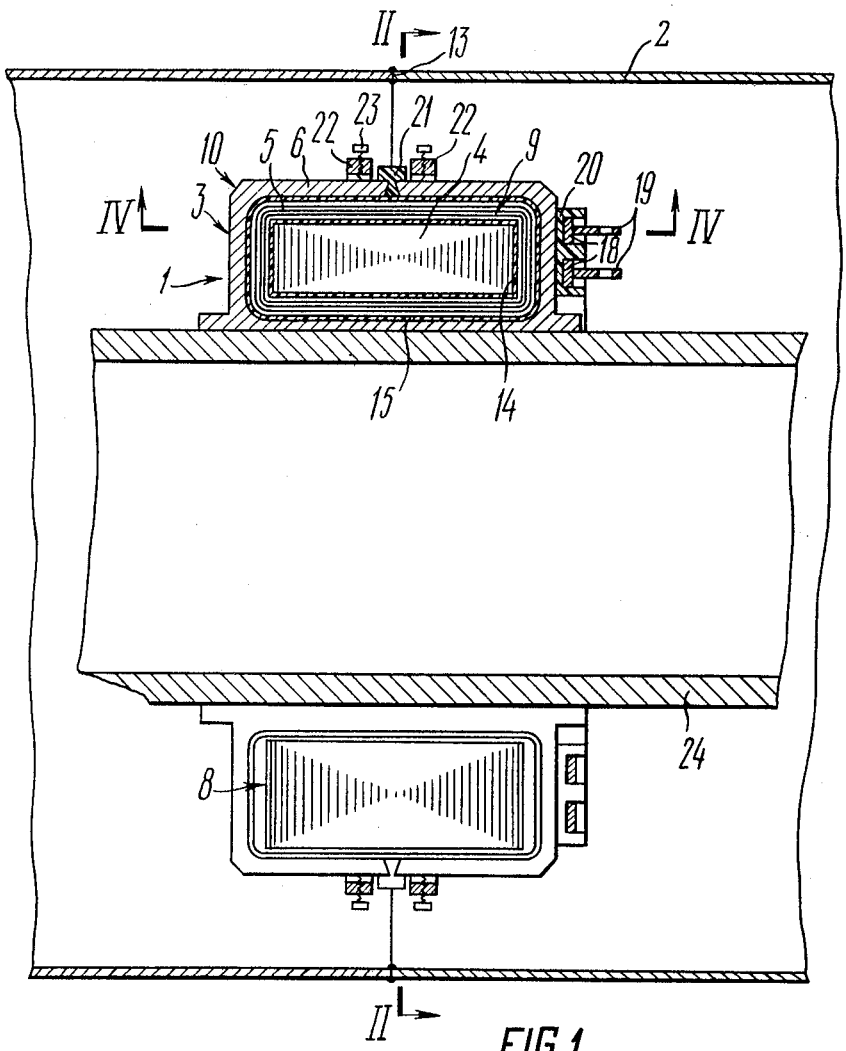
FIG. 1 is an elevation view of a ring transformer in accordance with the invention, arranged inside pipes being welded.

By way of an example, the ring transformer according to the invention is described with reference to a ring welding transformer 1 (FIG. 1) of a resistance butt welder intended for welding large-diameter pipes 2. It is implied that the welder is arranged inside the pipes 2.

Figure 2:
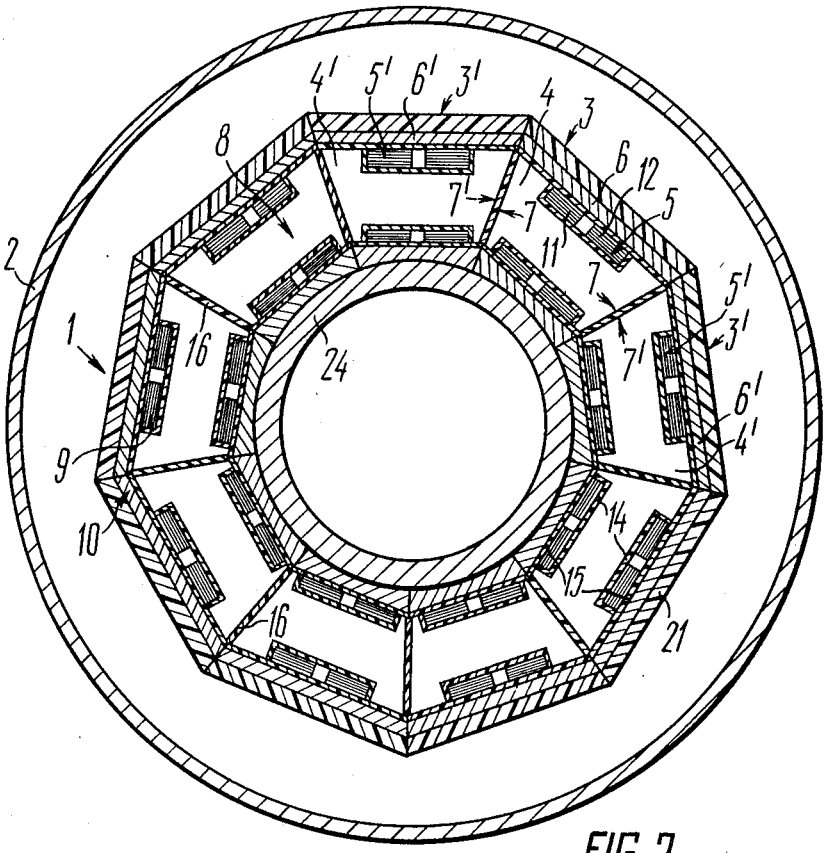
FIG. 2 is a section taken on line II—II of FIG. 1.

The ring transformer 1 (FIG. 2) is composed of a plurality of sections 3. According to the preferred embodiment under review, the transformer 1 comprises nine such sections 3. Each section 3 comprises, in turn, a non-closed magnetic core 4, a part of a primary winding 5 and a part of a secondary winding 6, and is so arranged with respect to other sections 3' that end faces 7 of its non-closed magnetic core 4 are in contact with end faces 7' of nonclosed magnetic cores 4' of the two adjacent sections, whereby all the non-closed magnetic cores 4, 4' of all the sections 3', 3 make up a closed magnetic core 8 of the transformer 1. The shape of the magnetic core 8 essentially corresponds to that of the pipes 2 being welded. The primary winding 5 of each section 3 is connected in series-parallel with primary windings 5' of the other sections 3', making up a primary winding 9 of the transformer 1. The secondary winding 6 of each section 3 and secondary windings 6' of the other sections 3' make up one turn of a secondary winding 10 of the transformer 1. (Hereinafter, all the sections are designated as 3; the non-closed magnetic cores are designated as 4; the primary and secondary windings of the sections 3 are designated as 5 and 6, respectively; and the end faces of the magnetic core 4 are designated as 7).

Figure 3:
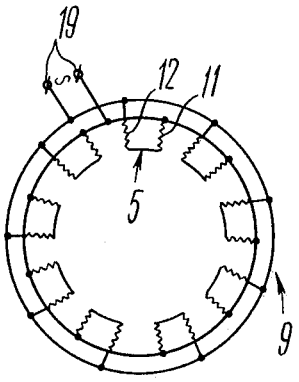
FIG. 3 is an electric diagram of the transformer of FIG. 1, showing series-parallel connection of primary windings of individual sections.

According to FIG. 3, the primary windings 5 of the sections 3 are placed in series-parallel. Each primary winding 5 has two portions 11 and 12, respectively. Such portions may be one and upwards in number.

The primary winding 9 (FIG. 1) and secondary winding 10 of the transformer 1 are mounted on the closed magnetic core 8 and primary winding 9, respectively, and uniformly extend along butts 13 being welded of the pipes 2; the primary winding 9 and secondary winding 10 are insulated from each other. The primary winding 9 is insulated from the magnetic core 8 on one side and from the secondary winding 10 on the other side by insulating spacers 14 and 15, respectively, made, for example, of glass fiber.

In order to reduce the magnetic induction at the places where the end faces 7 (FIG. 2) of the non-closed magnetic cores 4 of the sections 3 come into contact with one another and where gaps cannot be avoided, it is necessary that each non-closed magnetic core 4 should be of a variable cross-section increasing towards its end faces 7.

Of course, each non-closed magnetic core 4 may be of a constant sectional size, but this would mean an increased weight of iron and a greater weight and size of the transformer as a whole.

Interposed between the end faces 7 of the magnetic cores 4 of the sections 3 of the transformer 1 are spacers 16 of an elastic electrically insulating material, such as fluorineplastic. The spacers 16 insulate the end faces 7 of the non-closed magnetic cores 4 from one another, which rules out eddy currents and thus brings down losses. The elasticity of the spacers 16 makes the closed magnetic core 8 sturdy and vibration-free regardless of the effects of electromagnetic forces developing in the course of operation.

Figure 4:
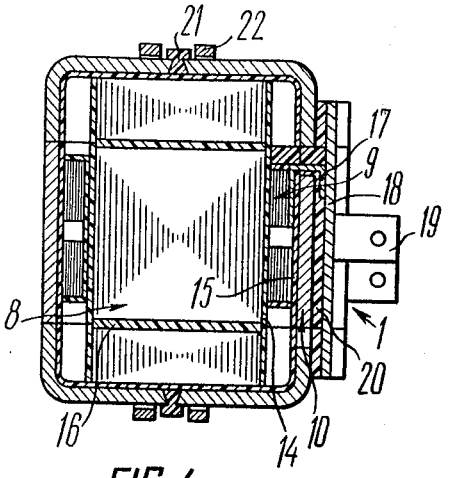
FIG. 4 is a section taken on line IV—IV of FIG. 1.

The primary winding 9 (FIG. 4) of the transformer 1 has leads 17 for connection to contact rings 18 connected, in turn, to terminals 19 and accommodated in grooves provided in inserts 20 which insulate the contact rings 18 from the secondary winding 10. Power is supplied to the terminals 19 from a power station (not shown) or from an a.c. network.

The ends of the turn of the secondary winding 10 (FIG. 1) are of opposite signs and insulated from each other by an insulator 21. Each of these ends is connected in a conventional manner through a respective current supply element (not shown) to the respective pipe 2 being welded. Folding of the ends of the turn of the secondary winding 10, which may occur under the action of electromagnetic forces, is prevented by two rings 22 of a nonmagnetic material provided with clamp bolts 23 and mounted right on the secondary winding 10, in immediate proximity to said ends of the turn of the secondary winding 10. If the secondary winding 10 is a multiturn winding, the number of the rings 22 is selected according to that of the turns, each ring being arranged in immediate proximity to a respective non-closed end of a respective turn. The clamp bolts 23 are manufactured from nonmagnetic steel.

The sections 3 of the transformer 1 are mounted on a housing; according to the embodiment under review, they are mounted on a hollow shaft 24 of the resistance butt welder, which serves to cool the welding transformer 1.

Figure 5:
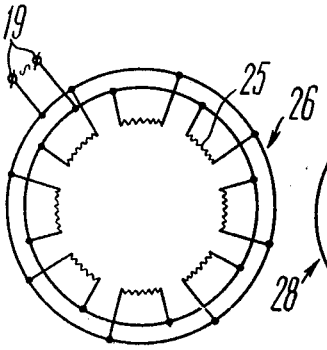
FIG. 5 is an electric diagram of a transformer according to the invention, showing parallel connection of primary windings of individual sections.
Figure 6:
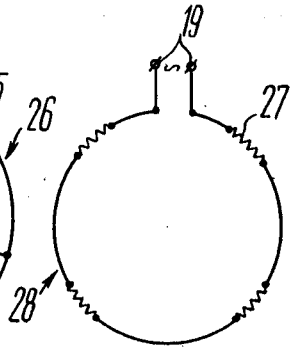
FIG. 6 is an electric diagram of a transformer according to the invention, showing series connection of primary windings of individual sections.

The preferred embodiment under review is concerned with a transformer comprising nine sections with two portions of the primary winding in each section and with the primary winding of each section connected in series-parallel with those of other sections. There may be different embodiments of the present invention. For example, a primary winding 25 (FIG. 5) of each section of the transformer may be connected in parallel with primary windings 25 of other sections, making up a primary winding 26 of the transformer. A primary winding 27 (FIG. 6) of each section may also be connected in series with primary windings 27 of other sections, making up a primary winding 28 of the transformer. In the former and latter cases there are eight and four sections, respectively, and the primary winding of a section has only one portion.

The ring transformer according to the invention for resistance butt welders is assembled as follows.

At the locations of the primary winding 5, the insulating spacers 14 are glued on the non-closed magnetic cores 4 (FIG. 2) of the sections 3. In the embodiment under review, the primary winding 5 is copper band which is wound around the magnetic core 4, after which the insulating spacers 15 are mounted on said primary winding 5. A part of the turn of the secondary winding 6, which is made of copper, is pressfitted on the non-closed magnetic core 4 with the part of the primary winding 5 and insulating spacers 15 on the side of the end face 7 of said magnetic core 4. The insulator 21 is then interposed between the non-closed ends of the turn of the secondary winding 6. Thus apart from its basic function, the secondary winding also serves as a jacket which fully protects the primary winding and magnetic circuit from drippings of molten metal in the course of welding and thus rules out short-circuiting. The design of the transformer according to the invention is such that the winding operations can be fully mechanized. As stated above, the windings are wound around the magnetic core, whereby the gap between the windings and magnetic core is reduced; this, in turn, reduces losses and improves the efficiency of the transformer.

The leads 17 (FIG. 4) of the primary winding 9 are passed through the grooves of the inserts 20 which are mounted on the turn of the secondary winding 10 and electrically insulate the leads 17 and contact rings 18 from said turn. The leads 17 are then successively connected to the respective contact rings 18.

The assembled sections 3 (FIG. 1) are mounted on the shaft 24, and the spacers 16 are arranged between the end faces 7 of the non-closed magnetic cores 4 of the sections 3. The ends of the turn of the secondary winding 10 are connected through appropriate elements of the resistance butt welder to the internal surfaces of the pipes 2 to be welded, in immediate proximity to the butts 13. The transformer is thus ready for operation.

By varying the arrangement and configuration of the sections, one can assemble a transformer fit for welding articles of any shape.

The ring transformer according to the invention for resistance butt welders is such that its manufacture can be almost completely mechanized. The transformer is highly reliable and readily lends itself to upkeep and maintenance. The transformer may be modified to fit the shape of articles to be welded, which can be done rapidly by varying the number of sections, without removing the transformer from the welder.

To switch over from welding articles of one shape to another, one can change the arrangement of the sections or replace some of the sections by those of a different configuration; one can also vary the capacity of the transformer by varying the number of sections.

The transformer according to the invention is simple in design and easy to maintain. It can be arranged at a minimum possible distance from the butts being welded, which reduces the resistance of the welder's secondary circuit; as a result, welding is carried out at a reduced capacity and with a lower power consumption.

What is claimed is:

1. A ring transformer for resistance butt welders, comprising:

a housing;

a plurality of sections, each comprising a non-closed magnetic core having end faces and sides confined by said end faces, a first insulating spacer arranged on said sides of said magnetic core, a primary winding portion wound around said first insulating spacer, a second insulating spacer applied onto said primary winding portion, a tubular secondary winding portion, having a first non-closed end and a second non-closed end and contacting with said second insulating spacer, and an insulator insulating said non-closed ends of said secondary winding portion;

each of said sections being mounted on said housing and so arranged with respect to the other sections that said end faces of its non-closed magnetic core are in contact with those of said non-closed magnetic cores of the two adjacent sections, whereby all the non-closed magnetic cores of all the sections make up a closed magnetic core of said transformer, whose shape essentially corresponds to that of articles to be welded, the primary winding portion of each section being connected to those of the other sections to make up a primary winding of said transformer, arranged on said first insulating spacer of the closed magnetic core and uniformly extending along the butts of articles to be welded, whereas the secondary winding portion of each section and those of the other sections A, have aligned first and second nonclosed ends and abutting tube ends to make up a secondary winding of said transformer, arranged on said second insulating spacer of said primary winding and uniformly extending along the butts of articles to be welded.

2. A transformer as claimed in claim 1, wherein said non-closed magnetic core of each section is of a variable cross-sectional area which increases towards said end faces of said non-closed magnetic core.

3. A transformer as claimed in claim 1, including a plurality of spacers of an elastic insulating material, interposed between said end faces of said non-closed magnetic cores of said sections.

4. A transformer as claimed in claim 1, including a first ring of a nonmagnetic material, mounted on said secondary winding of said transformer, in immediate proximity to the first non-closed end of said secondary winding; and a second ring of a nonmagnetic material, mounted on said secondary winding of said transformer, in immediate proximity to the second non-closed end of said secondary winding.

5. A transformer as claimed in claim 1, including a plurality of spacers of an elastic insulating material, interposed between said end faces of said non-closed magnetic cores of said sections.

6. A transformer as claimed in claim 2, including a first ring of a nonmagnetic material, mounted on said secondary winding of said transformer, in immediate proximity to the first non-closed end of said secondary winding; and a second ring of a non-magnetic material, mounted on said secondary winding of said transformer, in immediate proximity to the second non-closed end of said secondary winding.

7. A transformer as claimed in claim 3, including a first ring of a nonmagnetic material, mounted on said secondary winding of said transformer, in immediate proximity to the first non-closed end of said secondary winding; and a second ring of a non-magnetic material, mounted on said secondary winding of said transformer, in immediate proximity to the second non-closed end of said secondary winding.

* * * * *